United States Patent [19]

Mino et al.

[11] 3,951,839

[45] Apr. 20, 1976

[54] DETERGENT COMPOSITION

[75] Inventors: Junryo Mino, Kamagaya; Haruhiko Arai, Narashino, both of Japan

[73] Assignee: Kao Soap Co., Ltd., Tokyo, Japan

[22] Filed: Dec. 19, 1974

[21] Appl. No.: 534,908

[30] Foreign Application Priority Data

Dec. 27, 1973 Japan ..... 49-4220

[52] U.S. Cl. ..... 252/95; 252/97; 252/99; 252/186

[51] Int. Cl.[2] ..... C11D 3/395; C11D 7/54

[58] Field of Search ..... 252/95, 97, 99, 186

[56] References Cited

UNITED STATES PATENTS 3,356,612 12/1967 Guthrie ..... 252/95 X

*Primary Examiner*—Mayer Weinblatt

*Attorney, Agent, or Firm*—Woodhams, Blanchard and Flynn

[57] ABSTRACT

A detergent composition containing (a) from 0.001 to 1.0 percent by weight of at least one radical chain-inhibiting antioxidant selected from the group consisting of 4,4′-butylidene-bis(6-tert-butyl-3-methylphenol), 2,2′-butylidene-bis(6-tert-butyl-4-methylphenol), monostyrenated cresol, distyrenated cresol, monostyrenated phenol, distyrenated phenol and 1,1′-bis(4-hydroxyphenyl)cyclohexane and (b) 0.5 to 50 percent by weight of an oxygen-type bleaching agent.

3 Claims, No Drawings

DETERGENT COMPOSITION

BACKGROUND OF THE INVENTION

1. Field of the Invention

This invention relates to a detergent composition for home clothes laundering which contains both a specific type of antioxidant and an oxygen-type bleaching agent. More specifically, this invention relates to a detergent composition for household clothes laundering, containing blended therein an antioxidant having a specific chemical structure and an oxygen-type bleaching agent as critical components. The remainder of the detergent composition has a conventional formulation. The detergent composition, according to the invention, effectively prevents yellowing of washed clothes, which is a serious defect of conventional clothes washing detergents. Also, the whiteness and clean appearance of the washed clothes is retained for a long time.

2. Description of the Prior Art

During wearing, clothes become contaminated with sebum secreted from the human body, dust particles and dirt, oily soil and various other kinds of soil. It is known that these soils are not completely removed by washing, but rather some amount of them remains in clothes after washing and they accumulate in clothes during repeated wearings and washings. It is considered that the main cause of yellowing in clothes is this accumulated soil that is not removed by washing. Especially the residual sebum component undergoes autoxidation and becomes yellowed. Further, yellowing and color fading owing to oxidative degradation of fiber fabrics per se and autoxidative degradation and decomposition of fluorescent dyes or coloring dyes are also significant factors in causing yellowing.

Various attempts have heretofore been made to provide detergent compositions that prevent such yellowing in clothes. For example, it is known to employ carboxymethylcellulose or like substances in clothes washing detergent compositions as an anti-redeposition agent. However, a satisfactory solution of the problem of yellowing cannot be attained by such known methods. The main reason is that there is a limit on the washing power that can be attained by the combined used of a synthetic surfactant and a builder, and even if a fluorescent whitening agent is blended in the detergent compositions for improving the washing power, a wholly satisfactory effect cannot be obtained. Further, even when a fluorescent whitening agent is absorbed by yellowed clothes during washing, a fully satisfactory whitening effect cannot be expected.

SUMMARY OF THE INVENTION

It is, therefore, a primary object of this invention to provide a clothes washing detergent composition which can more effectively prevent yellowing of clothes.

More specifically, there is provided a clothes washing detergent composition, suitable for home laundering purposes, comprising as main ingredients an anionic organic surfactant or a nonionic surfactant, or mixtures thereof, and organic and/or inorganic builders, in accordance with conventional practice. According to the invention, the detergent composition contains a critical additive components (a) from 0.001 to 1.0 percent by weight of at least one radical chain-inhibiting antioxidant selected from the group consisting of 4,4′-butylidene-bis(6-tert-butyl-3-methylphenol), 2,2′-butylidene-bis(6-tert-butyl-4-methylphenol), monostyrenated cresol, distyrenated cresol, monostyrenated phenol, distyrenated phenol and 1,1′-bis(4-hydroxyphenyl)cyclohexane, as essentially the only antioxidant in the detergent composition, and (b) 0.5 to 50 percent by weight of an oxygen-type bleaching agent, as essentially the only bleaching agent in the detergent composition, both percentages being based on the total weight of the detergent composition.

As the oxgen-type bleaching agent used in this invention, there can be enumerated inorganic peroxy salts such as sodium perborate, and hydrogen peroxide adducts of inorganic metal salts such as sodium percarbonate, sodium persulfate having the formula $4Na_2SO_4.NaCl.2H_2O_2$, and hydrogen peroxide adducts of condensed phosphate salt such as sodium tripolyphosphate and sodium pyrophosphate.

As the anionic surfactant, there can be employed conventional clothes washing organic surfactants, for example, sodium alkylbenzene-sulfonates, sodium alkyl sulfates, sodium $\alpha$-olefin-sulfonates, sodium vinylidene-type-olefin-sulfonates and sodium alkane-sulfonates. As the nonionic surfactant, there can be employed in accordance with conventional practice, for example, polyoxyethylene alkyl ethers and polyoxyethylene alkylphenol ethers. As the builders, there can be used in accordance with conventional practice, for example, water-soluble inorganic builder salts such as condensed phosphoric acid salts, (e.g., sodium tripolyphosphate), carbonates, silicates and borates, and organic builders such as sodium nitrilotriacetate, sodium citrate, sodium polymaleate and carboxymethyl cellulose. These surfactants and builders are conventional ingredients in clothes washing detergent compositions and the invention does not pertain to any discovery relating to these components. They can be used in the conventional amounts.

It has recently been proposed to add an antioxidant to a clothes washing detergent composition for preventing yellowing or the like in clothes (Japanese Pat. Publication No. 8324/73). The present invention is uniquely different from this known method in the feature that a specific class of antioxidants is used in combination with an oxygen-type bleaching agent. This combination provides an unexpected synergistic yellowing-preventing effect, which is greatly superior to the effect attained by the use of an antioxidant alone.

A clothes bleaching agent generally has an oxidative activity, whereas an antioxidant by itself is oxidized to exhibit an oxidation-preventing effect on the clothes. In view of these properties of both the bleaching agent and the antioxidant, it is generally difficult to use these two substance in combination because the bleaching agent will oxidize the antioxidant so that neither substance exhibits fully its desired properties on clothes.

We have discovered, unexpectedly in view of the prior art, that a specific class of antioxidant substances is stable to the action of an oxygen-type bleaching agent. When used in combination, the oxygen-type bleaching agent and the anti-oxidant exhibit an unexpectedly superior anti-yellowing effect on clothes. This feature of this invention could not have been expected from the conventional technical knowledge in the art.

Antioxidants are roughly divided into two types, namely, the radical chain inhibitor-type and the peroxide-decomposing-type, depending on the mechanism of their functioning. Peroxide-decomposing agents decompose oxygen-type bleaching agents before same act on the substances that cause yellowing in clothes, thereby reducing the activities of both the antioxidant and the bleaching agent. Therefore, peroxide-decomposing-type antioxidants cannot be used in this invention. Many radical chain inhibitors are unstable to oxygen-type bleaching agents and they become colored owing to their own antioxidative action. For example, di-tert-butylhydroxytoluene (BHT), di-tert-butylhydroxyanisole (BHA) and 2,2'-methylene-bis(4-ethyl-6-tert-butylphenol) are well known as radical chain-inhibiting antioxidants, but for the reasons set forth above, a good effect cannot be obtained when they are used in combination with oxygen-type bleaching agents. Thus, in this invention it is critical that the radical chain-inhibiting antioxidant employed should not be oxidized by an oxygen-type bleaching agent, namely, the oxidation-reduction potential of the antioxidant should be higher than that of the oxygen-type bleaching agent, and that the antioxidant should have a much reduced self-coloring property. More specifically, in the detergent composition according to this invention, there is employed from 0.001 to 1.0 percent by weight of at least one member selected from the group consisting of 4,4'-butylidene-bis(6-tert-butyl-3-methylphenol), 2,2'-butylidene-bis(6-tert-butyl-4-methylphenol), monostyrenated cresol, distyrenated cresol, monostyrenated phenol, distyrenated phenol and 1,1'-bis(4-hydroxyphenyl)cyclohexane.

Clothes bleaching agents are roughly divided into two classes, namely, chlorine-type bleaching agents such as sodium hypochlorite and oxygen-type bleaching agents such as sodium percarbonate. The oxidation-reduction potential of chlorine-type bleaching agents is higher than that of all known antioxidants inclusive of those used in this invention. Therefore, when a chlorine-type bleaching agent is used, the antioxidant is oxidized and becomes red in color. For this reason, chlorine-type bleaching agents cannot be used in this invention.

In this invention, the amount of the radical chain-inhibiting antioxidant is 0.001 to 1.0 percent by weight, especially from 0.05 to 0.7 percent by weight, based on the total weight of the detergent composition. If the amount of the antioxidant is less than 0.001 percent by weight, a satisfactory effect cannot be obtained. When the amount of the antioxidant is larger than 1.0 percent by weight, the undesirable coloration of the antioxidant per se becomes significant, decomposition of the oxygen-type bleaching agent also occurs, and the desired effect of increasing whiteness while preventing yellowing is spoiled. Therefore, it is critical that the antioxidant is used in amounts with the range specified above.

The amounts of the oxygen-type bleaching agent is from 0.5 to 50 percent by weight, especially from 3 to 30 by weight, based on the total weight of the detergent composition. When the amount of the bleaching agent is less than 0.5 percent by weight, a significant effect cannot be obtained, and if the bleaching agent is added in an amount exceeding 50 percent by weight, no substantial commensurate increase of the effect is attained and the use of such a large amount of the bleaching agent is disadvantageous for economic reasons.

As pointed above, autoxidation is apparently a main cause of the undesired phenomenon of yellowing of clothes. The radical chain-inhibiting antioxidant has a yellowing-preventing effect by positively cutting or interrupting the autoxidation chain reaction system. The oxygen-type bleaching agent has an effect of decomposing and bleaching substances that cause yellowing. The radical chain-inhibiting antioxidant catches generated radicals and exhibits an antioxidative activity, but it is not fully effective used alone because its antioxidative activity is selective depending on the kinds of yellowing-causing substances that are present. Moreover, because the reaction of the antioxidant with the yellowing-causing substances is not carried out in the homogeneous state, some portions of the yellowing-causing substances are left unreacted with the antioxidant. In this invention, these deficiencies are overcome by using an oxygen-type bleaching agent in combination with such antioxidant, and an excellent yellowing-preventing effect is attained. Further, progress of oxidation or polymerization of soils and the like is reduced by using the antioxidant, and hence, the degree of polymerization in the yellowing-causing substances can be maintained at a relatively low level. Accordingly, these substances are much more highly oxidized and bleached by the bleaching agent that in the case when no antioxidant is used. In short, an excellent synergistic effect of achieving and maintaining a high level of whiteness in the clothes can be attained in this invention.

Additives customarily used in clothes washing detergent compositions, such as optical brightening agents, dyes and perfumes can be incorporated in the detergent composition of this invention in a conventional manner and in the conventional amounts. Further, the composition of this invention can be used effectively as a bleaching composition comprising an oxygen-type bleaching agent.

This invention will now be further described by reference to the following illustrative Examples.

EXAMPLE 1

Detergents having the compositions set forth below were subjected to the following test in order to evaluate the yellowing-preventing effect of these detergents.

| Component | Composition (% by weight) Detergent A (Invention) | Detergent B (control) | Detergent C (control) | Detergent D (control) |
|---|---|---|---|---|
| sodium alkylbenzene-sulfonate | 15 | 15 | 15 | 15 |
| sodium tripolyphosphate | 25 | 25 | 25 | 25 |
| sodium percarbonate tetrahydrate | 10 | 10 | none | none |
| sodium carbonate | none | none | 10 | 10 |
| sodium silicate | 5 | 5 | 5 | 5 |
| polyethylene glycol | 2 | 2 | 2 | 2 |
| fluorescent dye | 0.5 | 0.5 | 0.5 | 0.5 |
| antioxidant (as listed in Table 1) | 0.1 | none | 0.1 | none |
| sodium sulfate | 33 | 33 | 33 | 33 |

-continued

| Component | Composition (% by weight) Detergent A (Invention) | Detergent B (control) | Detergent C (control) | Detergent D (control) |
|---|---|---|---|---|
| water | balance | balance | balance | balance |
| total | 100 | 100 | 100 | 100 |

The above four detergent compositions were subjected to repeated soiling and washing according to the method described below, and allowed to stand still at a temperature of 40°C. and a relative humidity of 80 percent for 20 days. The degree of yellowing was evaluated based on the b value measured by using a photoelectric color-difference meter (color machine).

Preparation of the soiled cloth 0.5 g of mixed oily soil composed of equal amounts of squalene, triolein and oleic acid was added to 1 l of water, and the oily soil was sufficiently emulsified or dispersed at 55°C. by a homogenizer. 10 White cloths (having a size of 10 cm × 10 cm) were thrown into this soiling agent and they were agitated in the bath for 10 minutes at a rate of 200 rpm to soil the cloths.

| Washing conditions |
|---|
| Detergent concentration : 0.1% by weight |
| Hardness of washing water : 4° DH |
| Temperature : 20°C. |
| Bath ratio : 3 fabrics per 500 ml of washing liquid |
| Washing machine : Terg-O-Meter |
| Washing time : 10 minutes |
| Rinsing time : 5 minutes |

The results are shown in Table 1.

Table 1

| Antioxidant Employed in Detergents A and C | *b* Value Detergent A | Detergent B | Detergent C | Detergent D |
|---|---|---|---|---|
| This Invention | | | | |
| 4,4'-butylidene-bis(6-t-butyl-3-methylphenol) | −3.20 | −1.51 | −1.81 | +1.72 |
| distyrenated cresol | −2.95 | −1.51 | −1.21 | +1.72 |
| distyrenated phenol | −2.81 | −1.51 | −1.03 | +1.72 |
| 2,2'-butylidene-bis(6-t-butyl-4-methylphenol) | −3.21 | −1.51 | −0.99 | +1.72 |
| 1,1'-bis(4-hydroxyphenyl)-cyclohexane | −2.90 | −1.51 | −0.36 | +1.72 |
| Controls | | | | |
| 2,5-di-t-butyl-p-cresol | −1.90 | −1.51 | +1.05 | +1.72 |
| dibutylhydroxyanisole | −2.00 | −1.51 | +1.62 | +1.72 |
| 2,2'-methylene-bis(4-ethyl-6-t-butylphenol) | −1.61 | −1.51 | +1.58 | +1.72 |

A greater b value (higher "+" values) indicates a high degree of yellowing of the fabric, and a smaller b value (higher "−" values) indicates a higher degree of whitening of the fabric.

As is apparent from the results in Table 1, an excellent synergistic effect is obtained when specific antioxidants according to the invention are used in combination with an oxygen-type bleaching agent, as compared with the cases where other antioxidants or no antioxidants are employed.

EXAMPLE 2

Detergents having the compositions shown below were subjected to a long time wearing test to evaluate the yellowing-preventing effect.

| Composition A | % by weight |
|---|---|
| sodium β-olefin-sulfonate | 7 |
| sodium alkylbenzene-sulfonate | 9 |
| sodium tripolyphosphate | 20 |
| sodium silicate | 5 |
| sodium sulfate | 49 |
| fluorescent dye | 0.6 |
| perfume | 0.001 |
| water | balance |
| total | 100 |

This composition was prepared by the customary spray-drying method to form a granular detergent.

| Composition B | % by weight |
|---|---|
| granular sodium percarbonate | 100 |
| Composition C | |
| polyethylene glycol | 13 |
| water-soluble starch | 43 |
| carboxymethyl cellulose | 10 |
| antioxidant (as listed in Table 2) | 20 |
| Glauber's salt | 17 |
| total | 100 |

Compositions B and C were prepared by the customary granulation method.

Test Method

Cotton underwears were cut in half and then they were sewn together. Ten young men wore these underwears for 2 days, and the underwears were then allowed to stand still for 1 day in a room maintained at a temperature of 40°C. and a relative humidity of 80 percent. One half of each underwear was washed with a detergent prepared by mixing 70 parts by weight o the composition A, 29 parts by weight of the composition B and 1 part by weight of the composition C to form a detergent composition according to this invention, and the other half was washed with a detergent prepared by mixing 70 parts by weight of the composition A and 29 parts by weight of the composition B, namely, a comparative detergent free of the antioxidant. The washing was conducted at a bath ratio of 1 Kg/30 1 and a detergent concentration of 0.167 percent by weight by using city service water maintained at 30°C. and an ordinary household washing machine. This wearing-washing procedure was repeated for a total test period of one month.

After the above-mentioned wearing-washing test was conducted for 1 month, the b value was measured by using a color machine in the same manner as in Example 1. The results shown in Table 2 were obtained.

Table 2

| Antioxidant | *b* Value |
|---|---|
| not added | +5.2 |
| 4,4'-butylidene-bis(6-t-butyl-3-methylphenol) | −5.3 |
| 1,1-bis(4-hydroxyphenyl)-cyclohexane | −4.7 |

(Each *b* value is the average value of the values obtained with respect to 10 men.)

The b value of the cotton underwear before the test was −6.2.

As is apparent from the results shown in Table 2, the detergent composition of this invention comprising an antioxidant agent and an oxygen-type bleaching agent has high yellowing-preventing and whitening effects. These effects were apparent even on the naked eye observation in the above test.

EXAMPLE 3

Two detergents having the compositions set forth below were subjected to repeated soiling and washing test according to the method described below in order to evaluate the yellowing-preventing effect of these detergents.

| Composition (per cent by weight) | | |
|---|---|---|
| Component | Detergent E | Detergent F |
| sodium n-alkyl-benzene sulfonate | 20 | 20 |
| $4Na_2SO_4 \cdot NaCl \cdot 2H_2O_2$ | 15 | 15 |
| 4,4'-butylidene-bis (6-t-butyl-3-methyl phenol) (antioxidant) | 0.1 | 0 |
| sodium sulfate | balance | balance |
| total | 100 | 100 |

Method of the evaluation

Cotton underwears were cut in half and then were sewn together. Ten young men wore these underwears for two days and thereafter these underwears were each separated into half. One half of each underwear was washed with the detergent E above-prepared and the other half was washed with the detergent F. The washing was conducted at a detergent concentration of 0.16 per cent by weight and a bath ratio of 1kg/30 liter by using city service water maintained at [30°C. Subsequently, the washed half of the underwear was again sewn together and the ten men wore these underwears. This wearing-washing procedure was repeated for a total period of two months. After thin wearing-washing procedure, these underwears were allowed to stand for one month in a room maintained at a temperature of 40°C and a relative humidity of 80 percent. The yellowing-preventing effect of these detergents, E and F, was evaluated with naked eye.

The test results showed that the detergent E containing with an antioxidant and a bleaching agent has higher yellowing-preventing and whitening effects than the detergent F not containing an antioxidant.

The embodiments of the invention in which an exclusive property or privilege is claimed are defined as follows:

1. A clothes-washing detergent composition consisting essentially of a. from 0.001 to 1.0 percent by weight of at least one radical chain-inhibiting antioxidant selected from the group consisting of 4,4'-butylidene-bis(6-tert.-butyl-3-methylphenol), 2,2'-butylidene-bis(6-tert.-butyl-4-methylphenol), monostyrenated cresol, distyrenated cresol, monostyrenated phenol, distyrenated phenol and 1,1'-bis(4-hydroxyphenyl) cyclohexane, b. from 0.5 to 50 percent by weight of an oxygen-type bleaching agent selected from the group consisting of sodium perborate, sodium percarbonate, sodium persulfate, hydrogen peroxide adduct of sodium tripolyphosphate and hydrogen peroxide adduct of sodium pyrophosphate, and c. the balance is clothes-washing surfactant and water-soluble detergent builders.

2. A clothes-washing detergent composition as claimed in claim 1 in which the amount of said antioxidant is from 0.05 to 0.7 percent by weight and the amount of said oxygen-type bleaching agent is from 3 to 30 percent by weight.

3. A detergent composition as claimed in claim 1, in which said oxygen-type bleaching agent is sodium percarbonate.

* * * * *